US006393794B1

(12) United States Patent
Pellock

(10) Patent No.: US 6,393,794 B1
(45) Date of Patent: May 28, 2002

(54) TRUSS BRACE AND TRUSS STRUCTURE MADE THEREWITH

(75) Inventor: Michael A. Pellock, Edwardsville, IL (US)

(73) Assignee: MiTek Holdings, Inc., Wilmington, DE (US)

( * ) Notice: Subject to any disclaimer, the term of this patent is extended or adjusted under 35 U.S.C. 154(b) by 0 days.

(21) Appl. No.: 09/523,550

(22) Filed: Mar. 10, 2000

(51) Int. Cl.[7] ..... E04C 5/01

(52) U.S. Cl. ..... 52/696; 52/643; 52/203; 52/712; 52/715

(58) Field of Search ..... 52/692, 693, 696, 52/643, 703, 712, 714, 715, 720.1, 739.1

(56) References Cited

U.S. PATENT DOCUMENTS

| | | | | | |
|---|---|---|---|---|---|
| 1,455,712 | A | * | 5/1923 | Collins | 52/696 |
| 1,649,226 | A | | 11/1927 | Gstalder | |
| 1,685,729 | A | | 9/1928 | Stone | |
| 2,442,726 | A | | 6/1948 | Gstalder | |
| 2,964,807 | A | | 12/1960 | Kennedy | |
| 3,503,173 | A | | 3/1970 | Jureit | |
| 3,708,942 | A | | 1/1973 | Leonard | |
| 3,778,952 | A | * | 12/1973 | Soucy | 52/697 |
| 3,959,945 | A | | 6/1976 | Allen | |
| 4,040,232 | A | | 8/1977 | Snow et al. | |
| 4,064,671 | A | * | 12/1977 | Sauer | 52/696 |
| 4,078,352 | A | | 3/1978 | Knowles | |
| 4,122,647 | A | | 10/1978 | Kovar | |
| 4,207,719 | A | | 6/1980 | Knowles | |
| 4,241,557 | A | | 12/1980 | Jensen | |
| 4,246,736 | A | | 1/1981 | Kovar et al. | |
| 4,295,318 | A | | 10/1981 | Perlman | |
| 4,361,999 | A | | 12/1982 | Sidney | |
| 4,541,218 | A | | 9/1985 | Gottlieb | |
| 4,561,230 | A | | 12/1985 | Rionda | |
| 4,596,101 | A | * | 6/1986 | Brinker | 52/317 |
| 4,604,845 | A | | 8/1986 | Brinker | |
| 4,669,235 | A | | 6/1987 | Reinen | |
| 4,704,829 | A | | 11/1987 | Baumker, Jr. | |
| D293,416 | S | | 12/1987 | Krueger | |
| 5,024,039 | A | | 6/1991 | Karhumaki | |
| D318,785 | S | | 8/1991 | Dean | |
| 5,058,352 | A | | 10/1991 | Loiselle et al. | |
| 5,412,920 | A | | 5/1995 | Hess | |
| 5,423,156 | A | | 6/1995 | Nellessen, Jr. | |
| 5,592,800 | A | | 1/1997 | Koo et al. | |
| 5,606,837 | A | | 3/1997 | Holizlander | |
| 5,697,725 | A | * | 12/1997 | Ballash et al. | 52/696 X |
| 5,857,306 | A | | 1/1999 | Pellock | |
| 5,884,448 | A | | 3/1999 | Pellock | |
| 5,946,879 | A | | 9/1999 | Pellock | |
| 5,996,303 | A | | 12/1999 | Pellock | |

FOREIGN PATENT DOCUMENTS

| | | |
|---|---|---|
| DE | 1941737 | 2/1971 |

OTHER PUBLICATIONS

"HIB–91 Summary Sheet," Truss Plate Institute, Frames 1–6.

* cited by examiner

*Primary Examiner*—Beth A. Stephan
*Assistant Examiner*—Brian E. Glessner
(74) *Attorney, Agent, or Firm*—Senniger, Powers, Leavitt & Roedel

(57) ABSTRACT

A truss system utilizing braces to retain the trusses in spaced relation. The braces include a beam with retainers at opposite ends for forming a snap lock connection to adjacent trusses, fixing the spacing between the trusses. One retainer includes a yoke which will automatically position the brace in an orientation generally normal to the truss to which the brace is mounted. The other retainer is adapted to mount to an adjacent truss and form an interlock with a second brace extending to the next truss. The braces are lined in a row across a plurality of trusses positioned in generally parallel relationship.

32 Claims, 4 Drawing Sheets

TRUSS BRACE AND TRUSS STRUCTURE MADE THEREWITH

BACKGROUND OF THE INVENTION

The present invention relates to a truss brace for use to brace and accurately space trusses during construction of buildings or the like and to provide support for trusses after their installation.

Trusses are used in construction of buildings or the like to provide support for decking such as roof sheathing and flooring. Such trusses tend to be very long and although designed to adequately support downward loading, their length permits lateral movement of the trusses and truss components affecting the spacing therebetween. Bracing trusses is important to insure efficient construction. Accurate spacing of the trusses is also important because roof sheathing and flooring secured to trusses is typically precisely cut to standard dimensions, e.g. four foot by eight foot sheets of plywood or OSB (oriented strand board). Also, some roofing, e.g., sheet metal, is also precisely dimensioned likewise requiring accurate placement of trusses in order to install and secure the roofing in place. When preformed trusses are erected to form a roof for example, a first truss is placed in position on supporting walls in an upright position and held upright with suitable bracing. A second truss is then erected in position and held to the first truss with inter-truss bracing. Typically, inter-truss bracing for wood roof trusses is an elongate board, e.g., a 1×4, that is secured to a truss chord and extends laterally from the trusses to provide bracing for several trusses, the bracing being held in place with supplemental mechanical fasteners. In the construction of metal truss systems, an elongate rolled section of metal, e.g. a hat channel is used instead of the wood 1'4. It is secured in place to multiple trusses with mechanical fasteners. Although both of these brace systems are effective in achieving truss bracing, the overhang of an elongate board or channel for bracing requires extra labor in maneuvering subsequent trusses into place to avoid hitting the inter-truss bracing. The brace, because of its projecting into the area where the next truss is to be positioned, blocks freedom of movement of the subsequent trusses to position them in the proper location where the brace is projecting. An alternate and less desirable brace for wood trusses included short brace strips which were cut to a length generally at the construction site. The length is generally equivalent to the center-to-center spacing of the trusses and nailed into place onto two truss chords and spanned between only two trusses, immediate nailing being required to hold them in place. This required additional labor to maintain bracing as well as proper spacing. Even though the use of bracing that spanned several trusses was more effective at bracing and spacing, it caused the aforementioned inefficiency in maneuvering the trusses into place. Further, wood bracing if positioned on top of the truss chords had to be removed to install the sheathing so the sheathing would lie flat on the trusses. An example of a roof truss and truss brace are disclosed in U.S. Pat. No. 5,884,448 and is designed to be used with wood trusses. It utilizes integral nails for securement to the sides and tops of the truss top chords. This brace provides an improved brace, but still requires some additional effort and time upon installation to drive the nails into the sides of the truss members.

Increasingly, formed metal components are being used in place of wood in construction and are not readily adapted for use with accessories designed for use with wood components. Accessories for use with metal components such as truss braces need to be easy to position and secure since fastening requires special fasteners and the brace cannot easily be temporarily tacked in place and then moved to a final position for final securement. An example of such a fastener is a self tapping screw, e.g. a Tek® screw. In order to improve efficiency in construction, the quantity of fasteners should be kept low to reduce labor costs. Further, braces should be easy to position both preliminarily and finally and hold in alignment to brace the trusses against movement and to accurately position the trusses to reduce labor cost and provide good quality construction in the finished structure. Once finally positioned, the braces should be easy to secure in position. Further, such braces would also desirably help brace the trusses against lateral movement after construction of the truss system is completed. In order to reduce cumulative error over wide surfaces that span many truss systems, e.g., in roof construction, the braces would desirably be self squaring to the trusses to facilitate their installation. Moreover, it would be desirable to have the braces interlock and thereby form a run or row of braces in line to also facilitate construction of a truss system.

Thus, there is need for a simple brace for use with formed metal trusses that is efficient and simple to use to reliably brace trusses to form a truss system. The brace should also reliably space the trusses on predetermined centers along their length and be inexpensive to manufacture.

SUMMARY OF THE INVENTION

Generally the truss structure of the present invention utilizes a plurality of generally parallel trusses with braces secured to and extending between the chords of adjacent trusses for bracing and to position and maintain the trusses in generally parallel relationship. The braces utilize a snap lock preferably on both ends to secure and position themselves on to adjacent trusses. The snap locks can each include a channel for capturing a truss therein preventing lateral movement of one truss relative to the other truss. A brace bridging a pair of trusses will interlock with a brace bridging one of the bridged trusses with another adjacent truss and then additional braces will be used between the other erected trusses to fix the trusses in place after erection. The braces will retain themselves in place where preliminarily positioned until permanently secured in placed with fasteners. The fasteners and portions of the braces overlying the trusses are sufficiently thin that they will not interfere with the sheathing secured to the trusses. Moreover, the braces can be positioned where the edges of adjacent sheets of sheathing abut to help support the edges of the sheathing and to place some of the fasteners at the gaps between the sheathing members to provide space for the fasteners to further reduce curving of the sheathing at the fasteners.

Among the several objects and features of the present invention may be noted the provision of a brace for securing trusses at predetermined center spacings; the provision of a brace for use with metal trusses; the provision of a brace that will automatically square itself on the truss and between two adjacent trusses; the provision of a brace that will interlock with another brace to form a brace run extending across and spacing a series of generally parallel trusses; the provision of a brace that will retain itself in a preliminary or final position before being finally secured in place; the provision of a brace that is inexpensive to manufacture; the provision of a brace that can be formed as one piece from metal sheet; the provision of a brace that will provide a snap lock connection to a truss; and the provision of a truss system that utilizes such a brace with metal trusses to position a plurality of trusses in generally parallel relationship.

The present invention involve the provision of a brace for use in spacing structural trusses in a truss system. Each truss is formed by truss components. The brace comprises a beam having opposite first and second ends. A first retainer extends from the first end of the beam and has a transversely extending channel adapted to receive a truss component therein to connect the brace to a truss in a self-retaining position on the truss such that the beam extends generally perpendicularly outwardly from the truss toward an adjacent truss in the truss system. A second retainer extends from the second end of the beam and is adapted for engaging the adjacent truss for holding the adjacent truss and the truss in spaced relation relative to each other within the truss system.

The invention also involves the provision of a brace for use in spacing structural trusses in a truss system with each truss being formed by truss components. The brace comprises a beam having opposite first and second ends. A first retainer extends from the first end of the beam and a second retainer extends from a second end of the beam opposite the first end. The first retainer is adapted to hook onto a component of a first truss of the truss system without penetrating the truss component. The second retainer is adapted to hook onto a component of a second truss of the truss system without penetrating the truss component. The beam is constructed for extending between the first and second trusses for maintaining a substantially fixed space between the first and second trusses.

In another aspect of the invention, a truss system comprises trusses arranged in spaced apart, generally side-by-side relation in a structure. Elongate braces are provide with each brace extending between adjacent trusses and engaging the trusses for maintaining a desired spacing therebetween. The braces are arranged in a row extending generally orthogonally to the sides of the trusses such that the longitudinal axes of the braces are generally coincident. At least some of the braces in the row overlap each other where both engage the same truss. A first retainer is on a first end of the brace and is adapted to engage a truss component and to connect the brace to a truss in a self-retaining position on the truss. A second retainer is on a second end of the beam and is adapted for engaging the adjacent truss for holding the adjacent truss and the truss in spaced relation relative to each other within the truss system.

Another aspect of the invention relates to a brace for use in spacing structural trusses in a truss system, each truss being formed by truss components. The brace comprises a beam having opposite first and second ends. A first retainer extends from the first end of the beam and is constructed to be in a self-retaining position on the truss such that the beam extends outwardly from the truss toward an adjacent truss in the truss system. A second retainer extends from the second end of the beam and has a transversely extending channel adapted to receive a truss component therein to connect the brace to a truss holding the adjacent truss and the truss in spaced relation relative to each other within the truss system.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION

Figure 1:
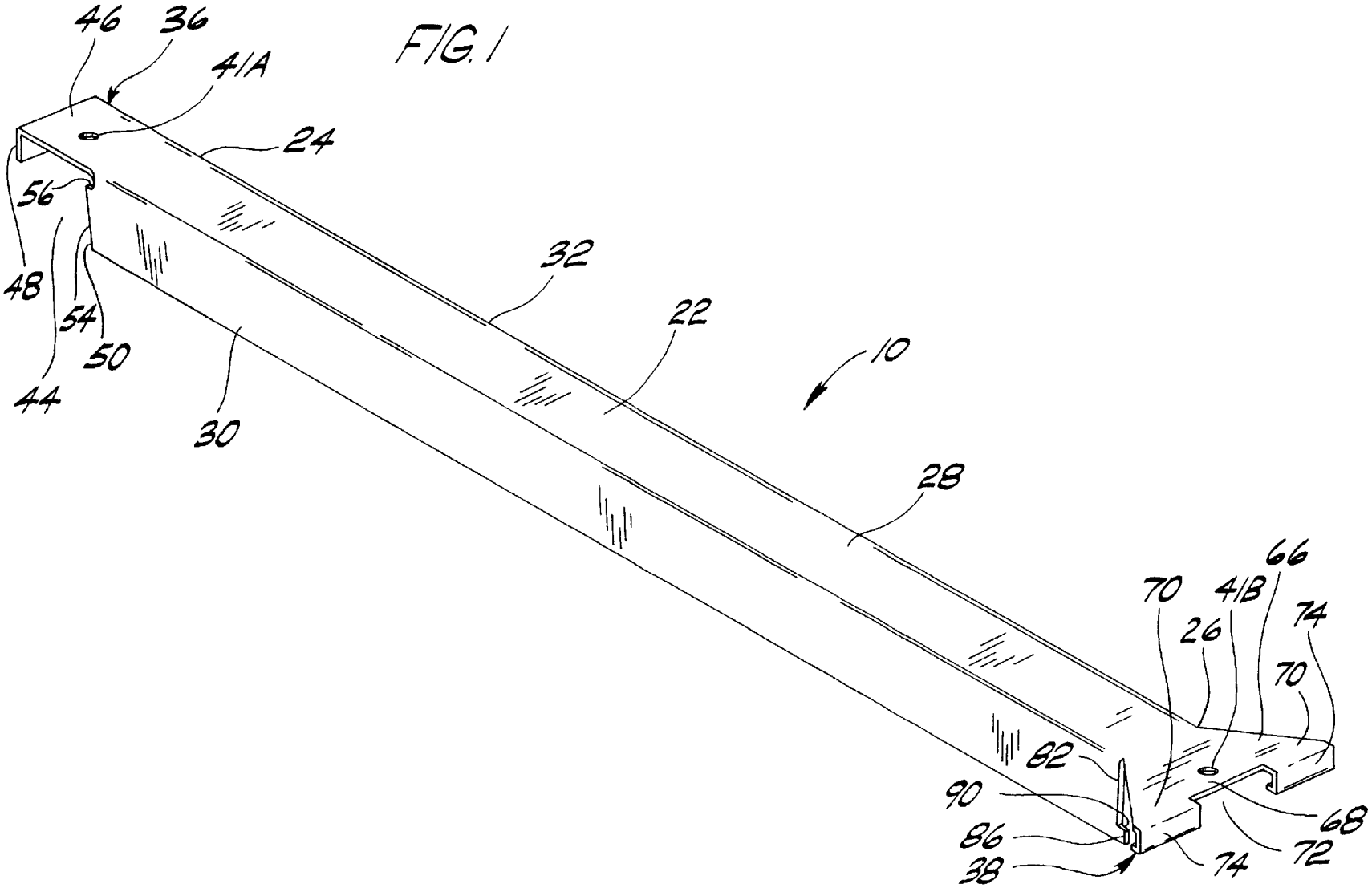
FIG. 1 is a perspective view of a brace mounted for use in spacing trusses.
Figure 3:
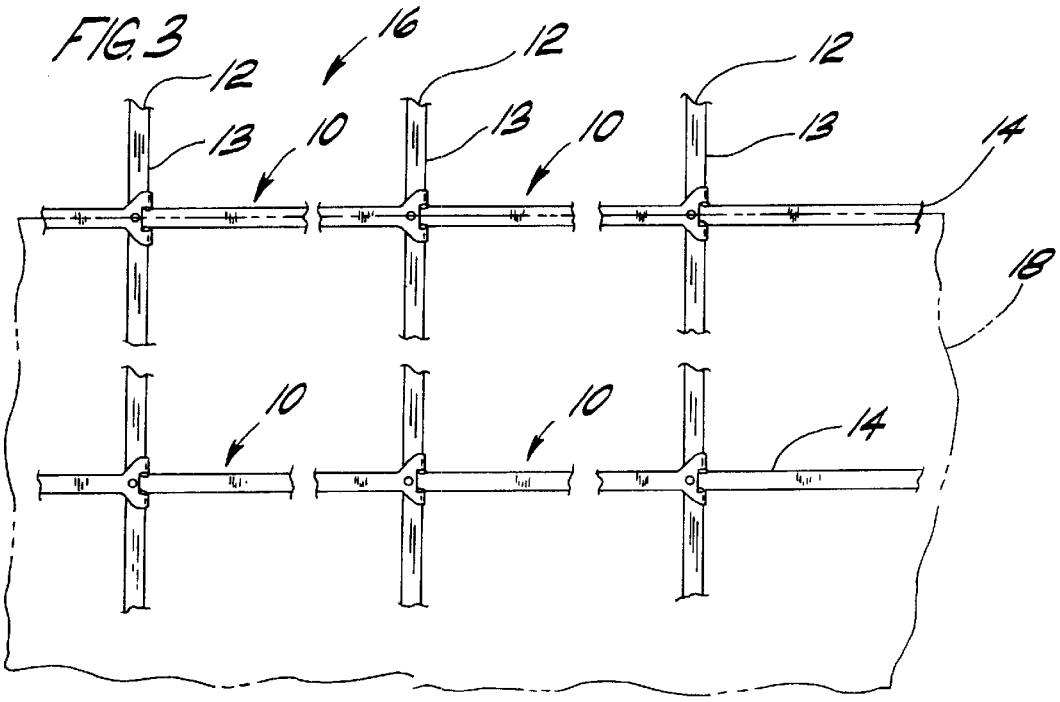
FIG. 3 is a plan view of a plurality of braces mounted to a plurality of trusses and showing one piece of sheathing in phantom secured thereto.
Figure 4:
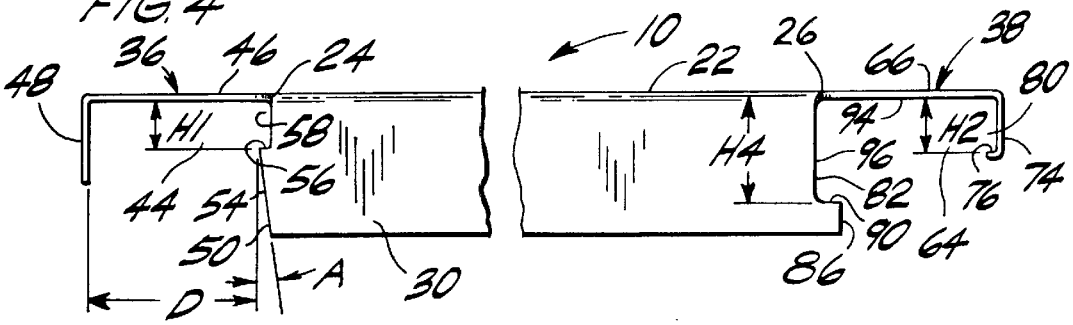
FIG. 4 is a fragmentary side elevation view of a brace with portions broken away to show detail thereof.
Figure 5:
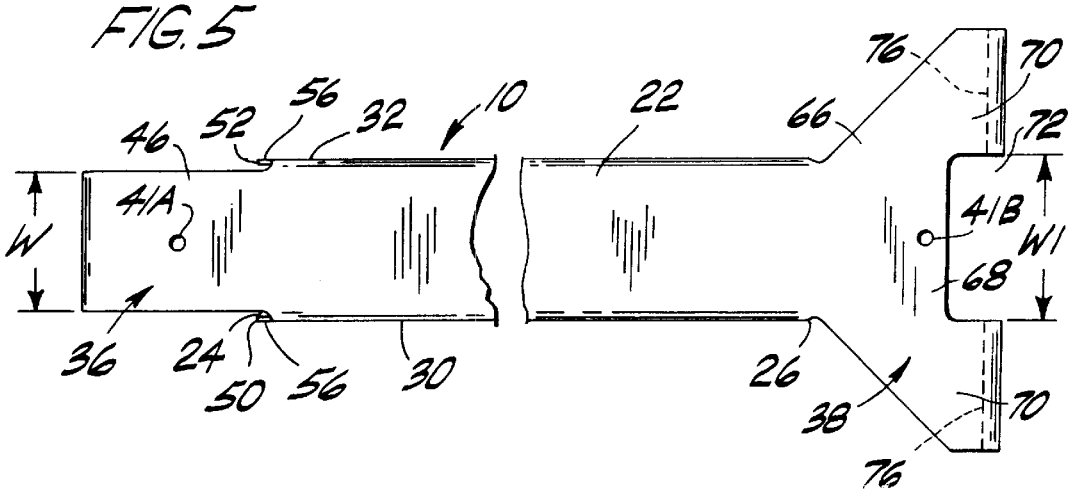
FIG. 5 is a fragmentary plan view of a brace with detail broken away to show detail thereof.
Figure 6:
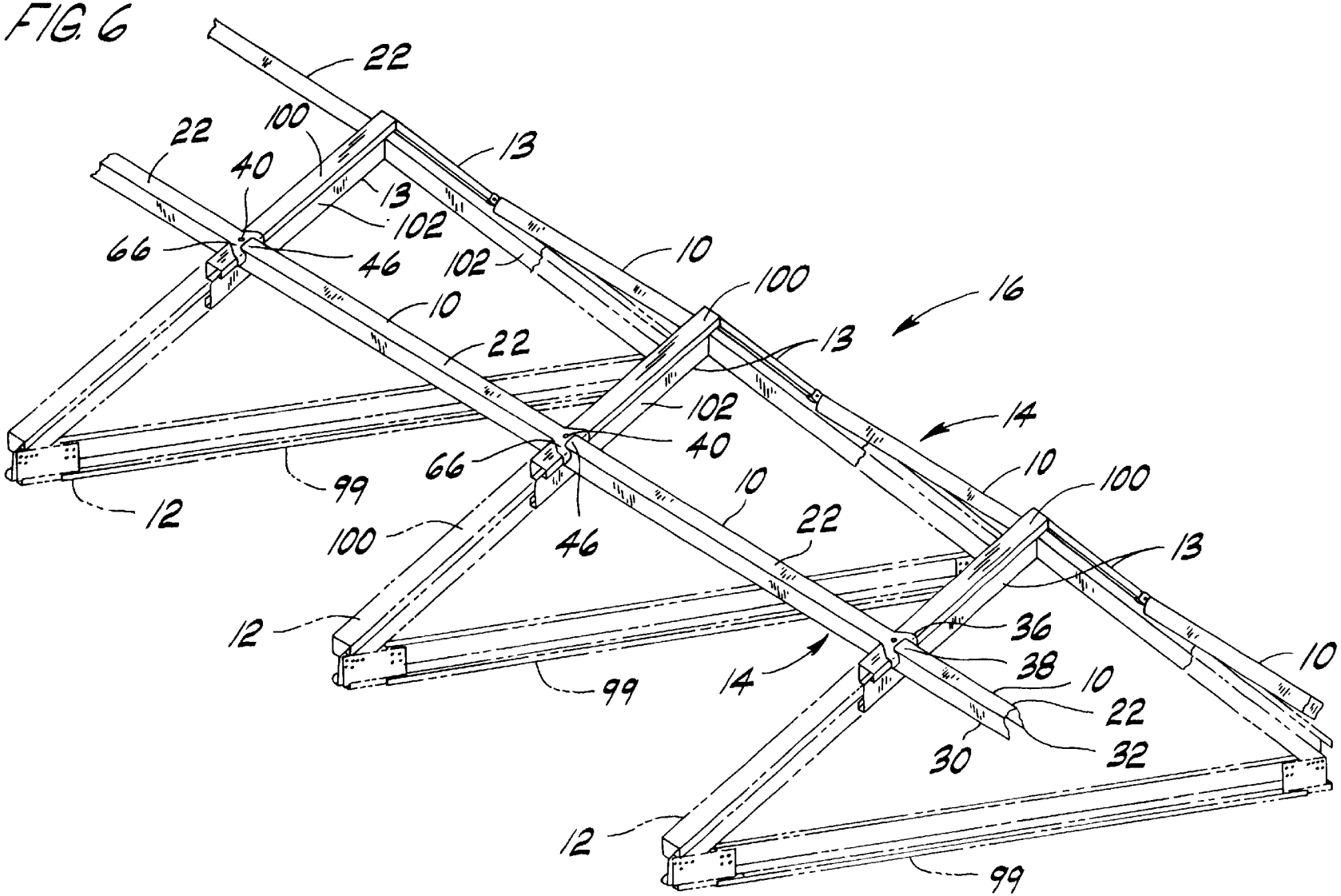
FIG. 6 is a fragmentary perspective view of adjacent trusses, shown partly in phantom, with braces secured to and extending in rows between adjacent trusses.

As seen in FIGS. 1, 4 and 5, a brace, designated generally as 10, is shown. The brace 10 is operable to fasten to and maintain trusses 12 in generally parallel spaced apart relation. The truss 12 when used in a roof includes a truss top chord 13. Such roof trusses are well known in the art and generally comprise a pair of top chords 13 to which sheathing 18 is secured and one or more bottom chords (not shown) connected to the top chords as is known. Reinforcing webs (not shown) can be connected between top and bottom chords to reinforce the truss against bending under load. A plurality of braces 10 are mounted to the trusses 12 and form one or more lines or rows 14 of braces 10 in end-to-end relation forming a truss system designated generally as 16 (FIGS. 3, 6). The braces 10 and hence the rows 14 are preferably generally normal to the longitudinal axes of the chords 13. The braces 10 interconnect and maintain the chords 13 in generally parallel relationship along their lengths. Overlayment or sheathing 18 is secured to the chords 13 of truss system 16 by suitable fasteners (not shown), to form a roof, floor, or the like (broadly "deck"), only one sheet being shown for clarity of the truss system 16. The sheathing is positioned in end-to-end and side-to-side abutting relation to form the deck.

As shown in FIG. 1, the brace 10 includes a central beam portion 22 with opposite ends 24, 26. In a preferred embodiment, the brace 10 is formed from sheet metal, e.g., galvanized steel with a gage in the range of about 14 thru about 24, preferably about 20, cut to form and then bent to a channel shape. The beam 22 includes a web 28 with depending spaced apart legs 30, 32 integral with the web all extending along a substantial portion of the length of the beam 22. The legs 30, 32 are generally parallel to one another and generally normal to the web 28. To facilitate formation of the beam 22, the web 28 and legs 30, 32 are generally planar.

The brace 10 includes latching retainers (generally indicate at 36 and 38) extending from the ends 24, 26 and operable for mounting the brace in self retaining position on chords 13 of adjacent trusses 12 without the requirement of a supplemental fastener or other securement means. The retainers are also operable to permit movement of a brace longitudinally along the chords 13 to permit adjustment of its position before finally securing the brace 10 to the trusses while remaining attached to the chords. As a result, the chords 13 are restrained against relative lateral movement during adjustment of the brace 10. It is contemplated that in some circumstances, some or all of the braces 10 could be removed from mounting on the chords 13 prior to securing all the sheathing 18 to the chords. The retainers 36, 38 have resiliently deformable components (described hereinafter) operable to form snap lock connections of the braces 10 to the chords 13 requiring no fasteners or other form of supplemental securement to initially attach the braces to the trusses 12. The retainers are also operable to allow the positioning of the braces in the rows or lines 14 in generally end-to-end relation (even though there will be some overlap of adjacent braces 10 at their ends when interlocked, they can still be considered to be in end-to-end relation). Interlocking adjacent braces at the chords permits the use of the same fastener 40 to secure two braces 10 to a chord 13 (FIG. 3). A brace 10 can be provided with apertures 41A, B adjacent the opposite ends of the brace to facilitate installation of the fasteners 40 for affixing the brace to the trusses 12. When the braces are installed, the apertures 41 A, B will be in alignment for overlapping braces on the same chord 13. Further, the retainers 36, 38 are operable to mount a brace 10 to a truss and automatically position the brace such that its longitudinal axis is generally normal or perpendicular to the longitudinal axis of the chords 13 to which the brace is mounted.

The retainer 36 includes a channel 44 that extends generally normal or transverse to the longitudinal axis of the brace 10 and, in use on a floor or roof truss, opens generally downwardly. The channel 44 is defined on two sides by a tongue 46 extending from the web 28 and generally coplanar therewith and a flange 48 that extends downwardly from a distal end of the tongue 46 being generally normal thereto and runs generally parallel to the channel 44 forming one lateral side thereof with the tongue forming a top side. The legs 30, 32 have end edges 50, 52 spaced from the flange 48 and define a lateral third side of the channel 44. The end edges 50, 52 each have an edge portion 54 commencing at a ledge 56 and are downwardly and inwardly tapered therefrom forming a tapered lead in to the channel 44. Preferably the angle of taper is in the range of about 10° thru about 25° and is indicated as angle A as best seen in FIG. 4. The ledges 56 and tongue 46 form a hook with a throat designated 58 for a purpose later described. The tongue 46 has width W and the distal end of the ledges 56 is spaced from the inside surface of the flange 48 a distance D. The throat 58 opens into the channel 44 and generally outwardly from the beam 22 and toward the distal end of the tongue 46.

The retainer 38 includes a channel 64 (FIG. 4) that extends generally normal or transverse to the longitudinal axis of the brace 10 and in use on a floor or roof truss opens generally downwardly. Channel 64 is generally parallel to channel 44 to receive respective ones of parallel chords 13. The channel 64 is defined on one side by a yoke 66 extending from the web 28. As seen in FIG. 1, the yoke 66 includes a generally Y-shaped panel 68 with two fingers 70 at the distal end. The panel 68 is preferably generally coplanar with the web 28. The fingers 70 define an opening 72 therebetween which is in line with the web 28 of the beam 22. The opening 72 has a width W1 which is slightly larger than the width W of the tongue 46 so that the tongue of another brace 10 can fit in the opening 72 between fingers 70. A flange 74 depends from the distal end of each finger 70 with each flange extending generally transverse or normal to the longitudinal axis of the brace 10 and generally normal to the panel 68. The flanges 74 have inturned lips 76 (toward the beam 22) that are spaced from the panel 68 and generally parallel thereto. The flanges 74, panel 68 and lips 76 form hooks with inwardly (toward the beam 22) opening throats 80. The legs 30, 32 have distal end edges 82, 84 respectively. Ears 86, 88 extend longitudinally away from the end edges 82, 84 respectively forming ledges 90, 92 respectively. The ledges 90, 92, respective end edges 82, 84 and a bottom surface 94 of the panel 68 define a hook with a throat 96 that faces or opens outwardly from the beam 22 and generally toward the throats 80. The channel 64 is defined by the bottom surface 94 of the panel 68, the flanges 74 and the edges 82, 84. The flanges 74 cooperate with the end edges 82, 84 to position the brace when mounted to a truss 12 and provide a brace that will automatically square itself to a truss when mounted thereon.

Figure 2:
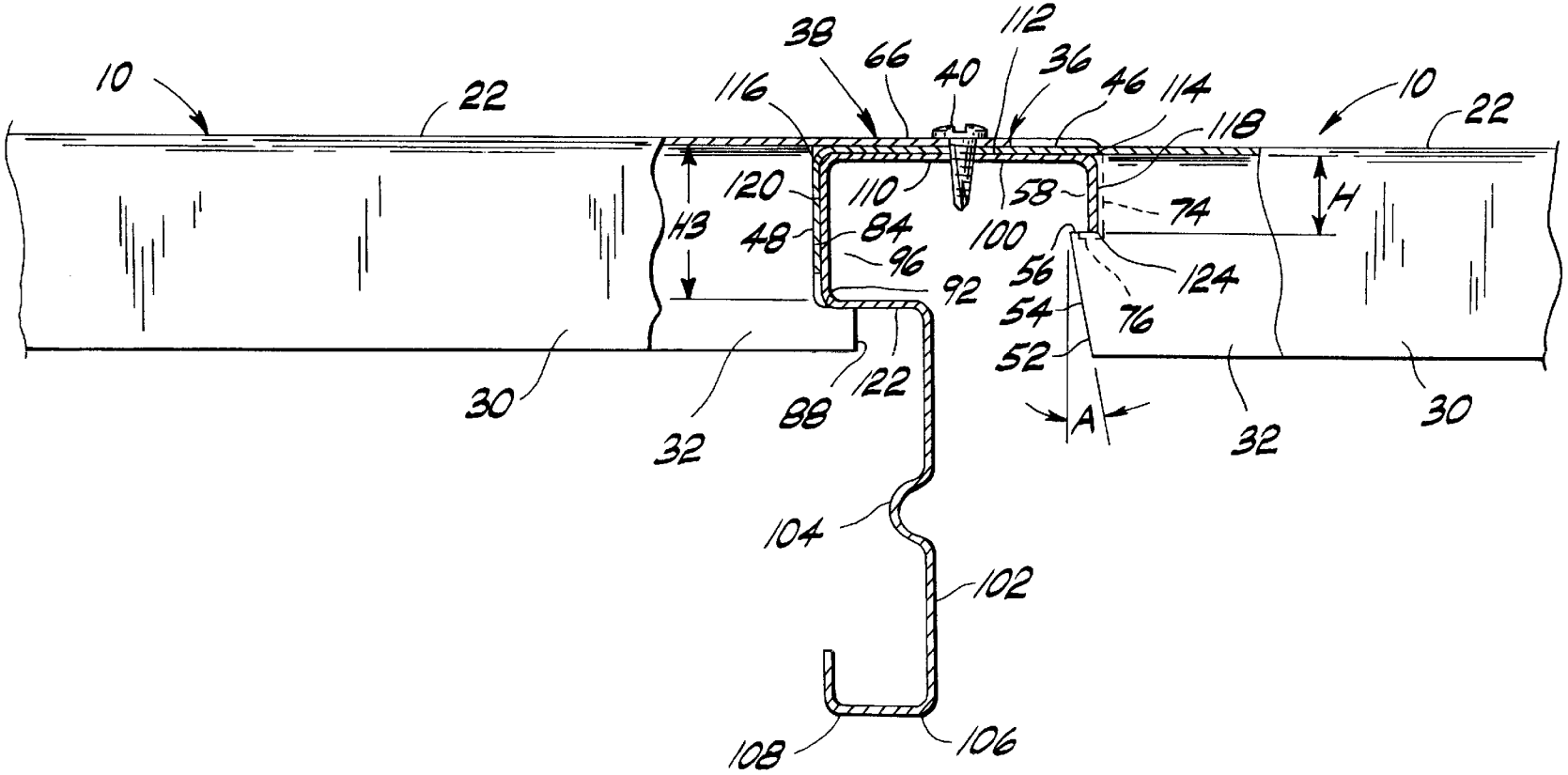
FIG. 2 is a side elevation view of a pair of braces mounted to a truss chord with portions broken away to show details.

The chord 13 is preferably made of metal, but other materials could be employed. A truss having metal chords of this type is disclosed in co-assigned U.S. Pat. No. 5,457,927 to M. Pellock and assigned to MiTek Holdings, Inc., the disclosure of which is incorporated herein by reference. Such a chord is sold under the trademark Ultra-Span by Mitek Industries, Inc. of St. Louis, Mo. The truss 12 is comprised of two or more upper chords 13 and a connector chord 99 as is known in the art. As seen in FIG. 2, the chord 13 includes a longitudinal rail 100 and a longitudinal web 102 which preferably are integral. A rib 104 is formed in the web 102 and extends laterally from one side face of the web 102 along the length thereof. At the bottom edge 106 of the web 102, there is provided an L-shaped member 108 that extends along the length of the chord 13 and is preferably an integral part of the chord. The rail 100 includes a support web 110 with a top surface 112 and opposite edges 114, 116 running along the length of the rail 100. A pair of laterally spaced apart and generally parallel stiles 118, 120 depend (when in use on floors and roofs) from a respective edge and extend along the length of the rail 100. The stile 118 has a height H less than the height H1 of the throat 58 of the retainer 36 and slightly less than the height H2 of the throats 80 of the retainer 38. The stile 120 has a height H3 less than the height H4 of the throat 96 of the retainer 38. An intermediate web 122 extends between the web 102 and the stile 120 integrally connecting the same together. The stile 118 has a bottom and downwardly facing edge 124. The edge 124 and the intermediate web 122 form latching shoulders extending along the length of the rail 100 for a purpose later described. The stile 118 and web 110 form a latching member that projects laterally outwardly from the rail 100 and the stile 120, web 110 and the web 122 form a second latching member that projects laterally outwardly from the rail 100 in a transverse direction opposite to that of the other latching member. Both latching members extend along the length of the chord 13.

In use, the trusses 12 are mounted in place to form a roof or the like with their opposite ends secured at a predetermined spacing, e.g., two feet center-to-center. At a predetermined location along the length of a first chord 13, preferably the end truss 12, the brace 10 is placed on the rail 100 of the chord by hooking the lip 76 of the retainer 38 under the edge 124 with the brace 10 being raised at an angle relative to plane defined by webs 110. The brace 10 is then rotated or pivoted downwardly until the bottom surface of the panel 68 engages the web 110 and the ledges 90, 92 latch under the ledge formed by the web 122. The panel 68 resiliently deforms allowing the ears 86, 88 to pass over the stile 120 and then thereunder whereby the ledges 90, 92 engage the intermediate web 122. The rail 100 is thus positioned and retained in the channel 64 between the flanges 74 and the edges 82, 84. The latching retainer 38 and hence the brace 10 is latched to the chord 13. When the brace 10 is rotated downwardly, the next chord 13 has its rail 100 received in channel 44 and retained between the flange 48 and edges 52, 54. Also, the adjacent rail 100 is latched to the brace 10 by having the stile 118 in the throat 58 retained between the ledges 56 and the bottom surface of the tongue 46. During movement of the rail 100 into the channel 44, the tongue 46 can resiliently deform allowing expansion of the opening into the channel 44. The taper of the edge portions 54 also facilitates the installation of the brace 10 on the second truss 12 by wedging the chord 13 into the throat 58.

The resiliency of the tongue 46 and the taper of the edge portions 54 leading to the throat 58 provide a snap-on connection. The latching retainer 36 and hence the brace 10 is latched to the chord 13 of the adjacent truss 12 in a manner not requiring piercing the chords 13. Thus, the adjacent trusses 12 and their chords 13 are retained in the appropriate spaced relation. If need be, the installed brace 10 may be moved longitudinally along the chords 13 to adjust its longitudinal position prior to securement with fasteners 40.

A third truss is then erected and a second brace 10 is then installed in end-to-end relation (there will be some overlap with the prior installed brace) with the preceding brace after which the next truss is erected and brace installed until all the trusses are erected. The subsequent brace has its yoke 66 placed in overlying relation to the tongue 46 of the already installed brace 10. The fingers 70 are positioned on opposite sides of the tongue 46 and the tongue fits within the opening 72. The second and subsequent braces 10 are then installed as was the first brace forming a row 14 of braces 10. A brace 10 captures the adjacent chords 13 and positively prevent relative lateral movement therebetween without the need for fasteners such as screws or nails. Fasteners 40 are then installed through the aligned openings 41A, 41B of overlapped retainers 36, 38 with one fastener being capable of securing two braces 10 to one chord 13. Additional rows 14 of braces 10 can be installed across the trusses 12 during or after truss erection if desired. The spacing of the rows of braces can be any desired spacing. It is contemplated that the braces can be positioned to underlie abutting ends of sheathing 18 to help support the sheathing ends, FIG. 3.

In view of the above, it will be seen that the several objects of the invention are achieved and other advantageous results attained.

When introducing elements of the present invention or the preferred embodiment(s) thereof, the articles "a," "an,", "the," and "said" are intended to mean that there are one or more of the elements. The terms "comprising," "including," and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A brace for use in spacing structural trusses in a truss system, each truss being formed by truss components, the brace comprising a beam having opposite first and second ends, a first retainer extending from the first end of the beam, the first retainer having a transversely extending channel adapted to receive a truss component therein and to connect the brace to a truss in a self-retaining position on the truss such that the beam extends generally perpendicularly outwardly from the truss toward an adjacent truss in the truss system, said first retainer is constructed for resiliently flexing when receiving a truss component for snap-locking engagement with the truss component, a second retainer extending from the second end of the beam being adapted for engaging said adjacent truss for holding said adjacent truss and the truss in spaced relation relative to each other within the truss system.

2. A brace as set forth in claim 1 wherein the first retainer is constructed for self-retaining connection of the brace to the truss component without piercing the truss component.

3. A brace as set forth in claim 2 wherein the beam comprises a generally flat web and opposed legs extending from opposite lateral edge margins of the web.

4. A brace as set forth in claim 3 wherein the first retainer comprises a finger extending longitudinally outwardly from the web of the beam generally in the plane of the web, the finger being formed by bends in the plane of the finger to hook onto the truss component.

5. A brace as set forth in claim 4 wherein the finger comprises a depending flange and an inwardly turned lip extending from the flange toward the beam.

6. A brace as set forth in claim 4 wherein the beam comprises a web and opposed legs extending from opposite lateral edge margins of the web, the legs each having distal edges including an outwardly projecting ear defining a throat along said distal edge sized to receive the truss component therein.

7. A brace as set forth in claim 6 wherein the finger is a thin sheet of resilient material adapted to flex upon attachment of the first retainer to the truss component for snap-locking engagement with the truss component.

8. A brace as set forth in claim 7 wherein the finger has a hole therein for receiving a fastener for fixing the brace to the truss component.

9. A brace as set forth in claim 4 wherein the first retainer comprises a pair of fingers, each finger being spaced laterally of the other finger.

10. A brace as set forth in claim 9 wherein the fingers are spaced for receiving a second retainer of another brace therebetween and onto the truss component.

11. A brace as set forth in claim 10 wherein each of the first and second retainers has a hole therein for receiving a fastener to fix the brace to truss components of the truss.

12. A brace as set forth in claim 1 wherein the second retainer comprises a channel extending transversely of the beam and sized for receiving a truss component of another truss therein.

13. A brace as set forth in claim 12 wherein the second retainer is constructed for flexing when receiving a truss component for snapping onto the truss component.

14. A brace as set forth in claim 13 wherein the beam comprises a generally flat web and opposed legs extending from opposite lateral edge margins of the web, the legs each having distal edges, the second retainer comprising a tongue extending outwardly from the beam generally in the plane of the web and a flange depending from an opposite end of the tongue, and wherein the distal edge of each leg is shaped to define a throat therein generally adjacent to the tongue, and has angled shape on the opposite side of the throat from the tongue for wedging the truss component into the throat.

15. A brace as set forth in claim 14 wherein the tongue of the second retainer has a hole therein for receiving a fastener to fix the brace to said other truss.

16. A brace for use in spacing metal structural trusses in a truss system, each truss being formed by truss components made of metal bent to shape, the brace comprising a beam having a cross section with a height dimension and having opposite first and second ends, a first retainer extending from the first end of the beam, and a second retainer extending from the second end of the beam opposite the first end, the first retainer being adapted to hook onto a component of a first truss of the truss system without penetrating the truss component and extending less than said height dimension of said beam cross section, the second retainer being adapted to hook onto a component of a second truss of the truss system without penetrating the truss component, the beam being constructed for extending between the first and second trusses for maintaining a substantially fixed space between the first and second trusses.

17. A truss system comprising, trusses arranged in spaced apart, generally side-by-side relation in a structure, plural elongate braces, each individual brace extending between adjacent trusses and engaging the trusses for maintaining a desired spacing therebetween, the braces being arranged in a row extending generally orthogonally to the sides of the trusses such that the longitudinal axes of the braces are generally coincident, at least some of the braces in the row overlapping each other where both engage the same truss, a first retainer on a first end of the brace, the first retainer engaging a truss component and connecting the brace to a truss in a self-retaining position on the truss, a second retainer on a second end of the brace engaging said adjacent truss for holding said adjacent truss and the truss in spaced relation relative to each other within the truss system, said retainers overlying the trusses are sufficiently thin that they will not interfere with sheathing secured to the trusses, the first and second retainers of adjacent braces in a row overlapping each other on one of the trusses, the first retainer having a transverse channel therein extending less than the depth of the brace and receiving a component of said one truss therein to connect the brace to said one truss.

18. A truss system as set forth in claim 17 wherein the braces are arranged in plural rows between the trusses.

19. A truss system as set forth in claim 17 wherein the first and second retainers of adjacent braces in a row overlapping each other on one of the trusses, the overlapping first and second retainers having aligned holes therein.

20. A truss system as set forth in claim 19 further comprising fasteners extending through the aligned holes in the overlapping braces in the row and into the truss for affixing the braces to the truss.

21. A truss system as set forth in claim 17 wherein the braces in the row are free of fixed connection to the trusses and are slidable along the trusses for selective location of the braces along the trusses.

22. A truss system as set forth in claim 17 wherein the first retainer is in snap-locking engagement with the truss component.

23. A truss system as set forth in claim 22 wherein the brace includes a beam extending between the first and second retainers and the first retainer comprises a finger extending longitudinally outwardly from the beam, the finger being hooked onto the truss component.

24. A truss system as set forth in claim 23 wherein the finger comprises a depending flange and an inwardly turned lip extending from the flange toward the beam.

25. A truss system as set forth in claim 23 wherein the beam comprises a web and opposed legs extending from opposite lateral edge margins of the web, the legs each having distal edges including an outwardly projecting ear defining a throat along said distal edge receiving the truss component therein.

26. A truss system as set forth in claim 23 wherein the first retainer comprises a pair of fingers, each finger being spaced laterally of the other finger.

27. A truss system as set forth in claim 26 wherein the fingers receive a second retainer of another brace therebetween and onto the truss component.

28. A truss system as set forth in claim 17 wherein the second retainer comprises a channel extending transversely of the brace less than the depth of the brace and receiving a truss component of an adjacent one of the trusses therein.

29. A truss system as set forth in claim 28 wherein the second retainer is snap-locked onto the truss component of said adjacent truss.

30. A truss system as set forth in claim 28 wherein the brace comprises a web and opposed legs extending from opposite lateral edge margins of the web, the legs each having distal edges, the second retainer comprising a tongue extending outwardly from the brace and a flange depending from an opposite end of the tongue, and wherein the distal edge margin of each leg is shaped to define a throat therein generally adjacent to the tongue, and has angled shape on the opposite side of the throat from the tongue.

31. A brace for use in spacing structural trusses in a truss system, each truss being formed by truss components, the brace comprising a beam having opposite first and second ends, a first retainer extending from the first end of the beam, the first retainer being constructed to resiliently flex when receiving a truss component for snap-locking engagement with said truss component in a self-retaining position on the truss such that the beam extends outwardly from the truss toward an adjacent truss in the truss system, a second retainer extending from the second end of the beam and having a transversely extending channel adapted to receive a truss component therein and to connect the brace to a truss holding said adjacent truss and the truss in spaced relation relative to each other within the truss system.

32. A brace as set forth in claim 31 wherein said first retainer comprises a pair of fingers extending outwardly from the beam, each finger being spaced laterally of the other finger forming an opening therebetween, and said second retainer comprises a finger extending outwardly from the beam and being sized to be received between the fingers of a first retainer of another said brace to form an interlock connection between a pair of braces.

* * * * *